US008132346B1

(12) United States Patent
Cooper et al.

(10) Patent No.: US 8,132,346 B1
(45) Date of Patent: Mar. 13, 2012

(54) IRON RETAINING SYSTEM AND SUPPORT DEVICE THEREOF

(75) Inventors: Kerry Cooper, Pleasantville, NY (US); George Calvin Scott, New Fairfield, CT (US)

(73) Assignee: Polder, Inc., Oxford, CT (US)

( * ) Notice: Subject to any disclaimer, the term of this patent is extended or adjusted under 35 U.S.C. 154(b) by 232 days.

(21) Appl. No.: 12/463,766

(22) Filed: May 11, 2009

(51) Int. Cl.
*D06F 81/00* (2006.01)
*D06F 79/00* (2006.01)

(52) U.S. Cl. ..... 38/107; 248/117.7

(58) Field of Classification Search ..... 38/103–107, 38/79, 96; 219/259; D32/73; 248/117.1–117.7
See application file for complete search history.

(56) References Cited

U.S. PATENT DOCUMENTS

| | | | | |
|---|---|---|---|---|
| 1,506,649 | A | 8/1924 | Lotte | |
| 1,598,488 | A | 8/1926 | Michael | |
| 2,341,090 | A | 2/1944 | Gey | |
| 2,750,697 | A | 6/1956 | Jacobson | |
| 3,951,369 | A | 4/1976 | Rocsak | |
| 4,368,863 | A | 1/1983 | Gentile | |
| 4,525,942 | A | 7/1985 | Azzara | |
| 4,657,213 | A | 4/1987 | Hartlage | |
| 5,108,056 | A | 4/1992 | McBounds | |
| 5,142,802 | A | 9/1992 | Krause | |
| 5,154,379 | A | 10/1992 | Parish | |
| D386,864 | S | 11/1997 | Ratliff et al. | |
| 5,909,862 | A | 6/1999 | Ratliff et al. | |
| 6,068,222 | A | 5/2000 | Stangeland | |
| D502,302 | S | 2/2005 | Verbeek | |
| D502,581 | S | 3/2005 | Lee | |
| 7,004,433 | B2 | 2/2006 | Clausen et al. | |
| 7,406,784 | B2 * | 8/2008 | Cevenini et al. | 38/107 |
| 2010/0242317 | A1 * | 9/2010 | Trowsdale et al. | 38/103 |

FOREIGN PATENT DOCUMENTS

| | | | |
|---|---|---|---|
| CA | CN201634933 | * | 11/2010 |
| DE | 004004327 | A1 * | 8/1991 |
| DE | 19526637 | * | 1/1997 |
| DE | 29905497 | * | 6/1999 |
| FR | 2575774 | A1 | 7/1986 |
| GB | 623648 | * | 5/1949 |

OTHER PUBLICATIONS

International Search Report of corresponding PCT application No. PCT/US2010/031993.

International Preliminary Report on Patentability and Written Opinion issued Nov. 15, 2011 in related International Patent Application No. PCT/US2010/031993.

* cited by examiner

*Primary Examiner* — Ismael Izaguirre

(74) *Attorney, Agent, or Firm* — Venable LLP; Frank M. Gasparo; Leigh D. Thelen

(57) ABSTRACT

A system for retaining a clothes iron includes a base plate having vertically offset front and rear portions configured to support a nose sole plate portion and a heal portion of the clothes iron, respectively, and lateral side portions configured to support opposing lateral side sole plate portions of the clothes iron, and a pair of holding arms configured to move from a first position below the base plate to a second position above the base plate and to contact side body portions of the clothes iron.

30 Claims, 4 Drawing Sheets

IRON RETAINING SYSTEM AND SUPPORT DEVICE THEREOF

BACKGROUND

1. Technical Field

The embodiments described herein relate to a system for retaining and storing a clothes pressing device, and more particularly, to a system for securely and conveniently retaining a clothes iron and a supporting device thereof.

2. Related Art

Conventional clothes irons are designed to have a substantially pointed forward portion and a relatively flat heal portion. During and after pressing of clothing, the hot clothes iron is usually placed on the surface of an ironing board to cool down. In addition, most consumers will typically leave the clothes iron standing on the heal portion in an upright orientation on the ironing board until the next time that clothes are to be ironed. However, since the surface area of the heal portion of the clothes iron that contacts the ironing board is relatively small and the clothes iron is usually top heavy, there is a significant chance that the clothes iron will be knocked over by a relatively minor bumping of the ironing board. As a result, the clothes iron, the ironing board cover, and the iron board can be damaged.

Moreover, ironing boards are notoriously unstable, thereby increasing the likelihood that the minor bumping of the ironing board will cause the clothes iron to tip over and possibly fall to the floor. Here, the clothes iron will undoubtedly become damaged due to the impact with the floor and, if just recently used, the still-hot iron will burn the floor surface and may cause the floor surface to catch fire.

In addition, due to their configuration, a clothes iron is difficult to store with a folder ironing board. Although there are many different arrangements for individually storing both the clothes iron and the ironing board, there exists no convenient way to simultaneously store the ironing board with the clothes iron attached.

Accordingly, a system for retaining and storing the clothes iron is needed that prevents the clothes iron from being inadvertently knocked to the ground both during and after the ironing of clothes. In addition, a system is needed that will provide safe storage of the clothes iron between time periods when clothes are to be ironed.

SUMMARY

A system for securely and conveniently retaining a clothes iron is described herein.

In one aspect, a system for retaining a clothes iron includes a base plate having vertically offset front and rear portions configured to support a nose sole plate portion and a heal portion of the clothes iron, respectively, and lateral side portions configured to support opposing lateral side sole plate portions of the clothes iron, and a pair of holding arms configured to move from a first position below the base plate to a second position above the base plate and to contact side body portions of the clothes iron.

In another aspect, a support device for a clothes iron retaining system includes a base plate having a rear support portion configured to support a heal portion of the clothes iron, a front support portion configured to support a front shoe plate portion of the clothes iron, and opposing lateral side portions, each including a supporting portion configured to support opposing lateral shoe plate portions of the clothes iron, wherein the rear support portion and the front support portion are offset along a vertical direction corresponding to a height difference between the heal and front shoe plate portions of the clothes iron.

These and other features, aspects, and embodiments are described below in the section "Detailed Description."

BRIEF DESCRIPTION OF THE DRAWINGS

Features, aspects, and embodiments are described in conjunction with the attached drawings, in which.

DETAILED DESCRIPTION

Figure 1:
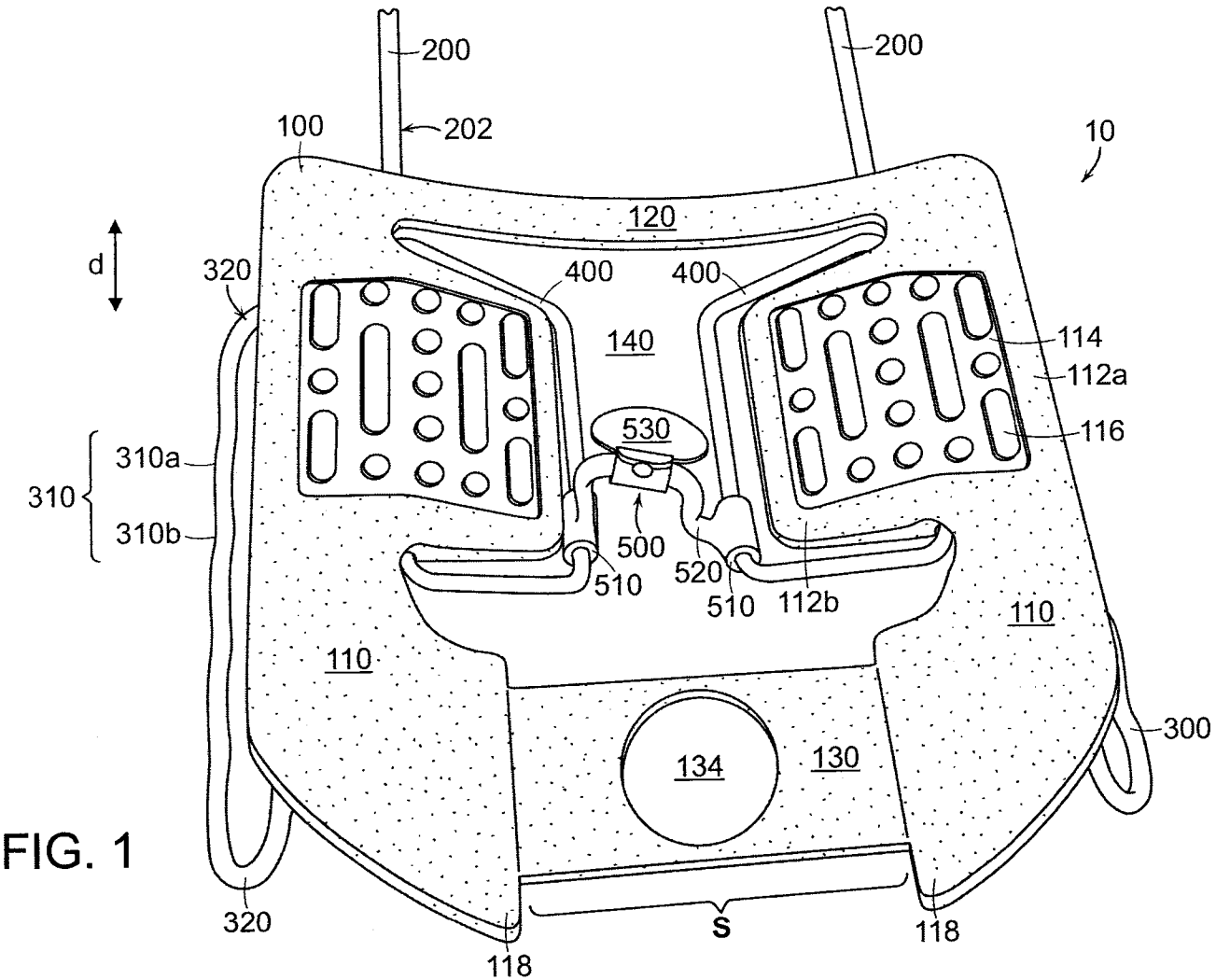
FIG. 1 is a perspective view of an exemplary system for retaining a clothes iron according to one embodiment.
Figure 2:
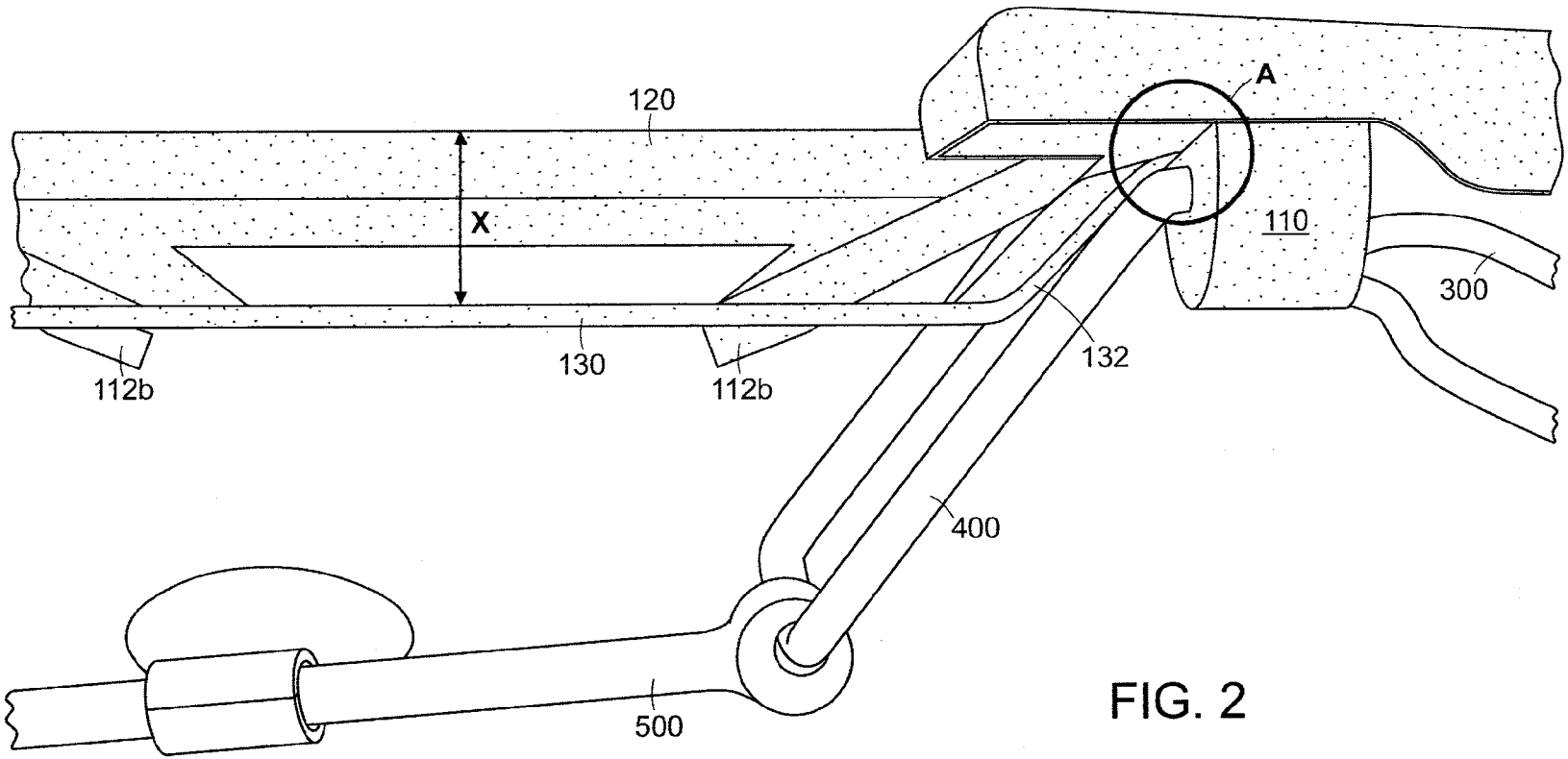
FIG. 2 is an front view of the exemplary system of FIG. 1 according to one embodiment.

FIG. 1 is a perspective view of an exemplary system for retaining a clothes iron according to one embodiment. In FIG. 1, the exemplary iron holder system 10 includes a base plate 100, a pair of attachment arms 200, accessory bars and cord wrap 300, holding arms/bars 400, and an attachment strap 500. The base plate 100 may be formed of heat conductive material(s), such as metals, composites, and hybrid combinations thereof, and may have a generally polygonal shape. For example, the base plate 100 may include side portions 110, a rear portion 120, and a front portion 130 surrounding a generally I-shaped open region 140. In addition, the base plate 100 may have a slight concavity inwardly toward the open region 140 such that the rear portion 120 is curved. However, the front portion 130 may have a generally planar surface compared to the rear portion 120. In addition, each of the side portions 110 may have a generally planar surface portion 112*a* and a slightly angled supporting portion 112*b* that extends inwardly toward the open region 140 and below the surface portion 112*a*, as shown in FIG. 2. For example, the supporting portion 112*b* may extend below the front portion 130.

Each of the side portions 110 may include an insert 114 that may be removably attached to the surface portion 112*a* and supporting portion 112*b* from beneath the base plate 100. In addition, the insert 114 may include a plurality of raised members 116 having different geometrical shapes or lines. For example, as shown in FIG. 1, the plurality of raised members 116 may include circular and oval geometric shapes that may be aligned along a longitudinal direction 'd' of the base plate 100.

The insert 114 may be formed of resilient heat resistant material(s), such as silicone rubber. In addition, the insert 114 may be formed of combinations of materials such that the plurality of raised members 116 are formed of material(s) different from the insert 114. Moreover, the plurality of raised member 116 may be molded from the same material(s) of the insert 114, or may be formed as individual pieces that may be inserted into the insert 114.

In FIG. 1, the rear portion 120 may be disposed substantially between the pair of attachment arms 200, and may be aligned with the front portion 130. However, the upper surface of the rear portion 120 is positioned at a height 'x' above the upper planar surface of the front portion 130, as shown in FIG. 2. Generally, clothes irons have sole plates (i.e., the metal plate that transfers heat to the clothes) that do not extend completely to the heal portion of the clothes iron body.

Accordingly, the upper surface of the rear portion 120 is preferably offset from the upper planar surface of the front portion 130. In the event that the clothes iron to be retained has a sole plate that extends fully from the front to the heal of the clothes iron body, the base plate will include substantially coplanar upper surfaces of the rear portion 120 and the front portion 130.

In addition, the supporting portions 112*b* extend below the front portion 130. The front portion 130 may formed as an integral part of the base plate 100, or may be formed as a separate member and joined to an underside of the base plate 100. Here, as shown in FIG. 2, the front portion 130 is shown to be formed as a separate member having sides 132 joined to an underside of the base plate 100 at a general region A. As a result, the front portion 130 is disposed within a spacing 'S' between lateral opposing sides 118 of the side portions 110. Although the sides 118 are shown to be substantially parallel, they may be mutually positioned at an angle from the direction 'd'.

In FIG. 1, the front portion 130 is shown to include an opening 134 centrally located between the sides 118 of the side portions 110. Alternatively, the opening 134 may include different geometries, and may include a plurality of openings. Here, the opening 134 may provide for improved cooling of the base plate 100 and a shoe plate of the clothes iron, as detailed below. In addition, the opening 134 may be provided as a location for inserting a member having a brand logo. Moreover, the opening 134 may be filled with thermally conductive material(s) to aid in cooling of base plate 100, or cooling of a clothes iron, as detailed below.

The pair of attachment arms 200 may be attached to an underside of the base plate 100 to extend along the direction for attachment to an ironing board, or for attachment to another platform used to provide a supporting surface for ironing of clothing. In addition, the pair of attachment arms 200 may be adjustably spaced apart to accommodate for various ironing board configurations. Moreover, although the pair of attachment arms 200 are shown to be substantially parallel members 202, each of the members 202 may have substantially bent portions to provide additional vertical and lateral support when the iron holder 10 is attached to the ironing board. Alternatively, instead of a pair of attachment arms 200, a single member 202 may be provided to extend from a central region of the rear portion 120. Here, use of the single member 202 would preferably include substantially bent portions.

For example, the pair of attachment arms 200 may extend beneath a rear portion of an ironing board and be affixed to the underside of the ironing board such that the upper surface of the base plate 100 may be substantially coplanar with an ironing surface of the ironing board. Alternatively, the pair of attachment arms 200 may be formed to include adjustable offset portions (not shown) to either raise or lower the upper surface of the base plate 100 substantially above or below the ironing surface of the ironing board.

Although the pair of attachment arms 200 are shown in FIG. 1 to extend from the rear portion 120 of the base plate 100, the pair of attachment arms 200 may instead be provided to extend from the front portion 130. Alternatively, the pair of attachment arms 200 may be provided with the base plate 100 so as to be user selectable to extend from either the rear portion 120 or the front portion 130.

The accessory bars 300 are shown to extend along the direction 'd' and correspond to the side portions 110. The accessory bars 300 include curved portions 310 and rounded ends 320. The curved portions 310 include alternating upper and lower regions 310*a* and 310*b* along an entire length of the accessory bars 300. Here, the upper regions 310*a* delineate the accessory bars 300 such that hangers can be retained in the lower regions 310*b*. Moreover, each of the lower regions 310*b* may be provided such that a plurality of hangers may be retained. Accordingly, as a piece of clothing is ironed, it may be placed onto a hanger and then hung on one of the lower regions 310*a*.

In addition, the curved portions 310 may be used to hang various other items that may be used during the ironing of clothes. For example, the squeeze handle portion of a spray water bottle may be hung from the curved portions 310. In addition, the electrical cord of a clothes iron can be wound around the rounded ends 320 of the accessory bars 300 for storage, or during ironing when the electrical cord is too long.

Figure 3:
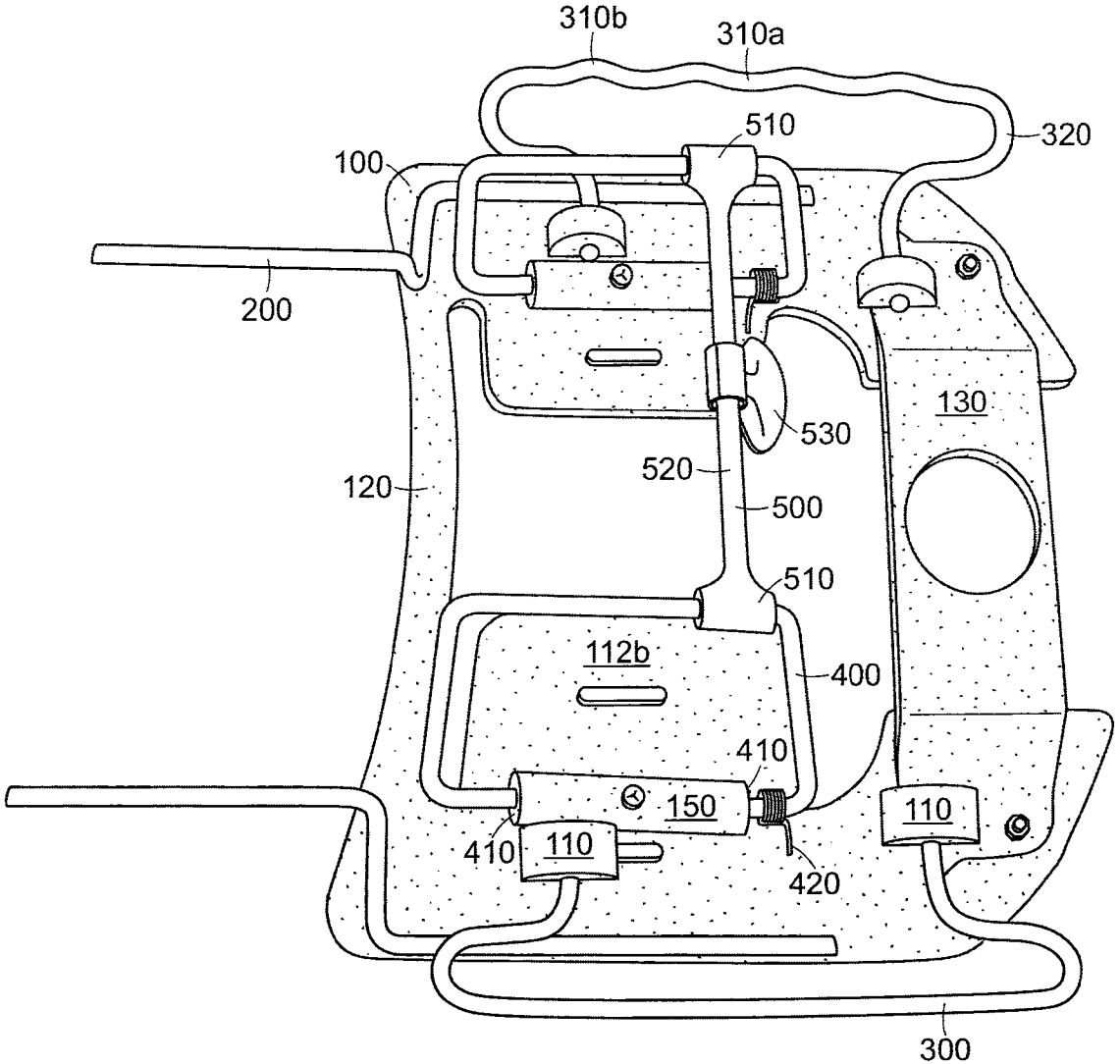
FIG. 3 is backside view of the exemplary system of FIG. 1 according to one embodiment.

As shown in FIG. 3, for example, the accessory bars 300 may be attached to the underside of the base plate 100 by attachment portions 110 corresponding to both the front portion 130 and the rear portion 120. In addition, each of the accessory bars 300 may be removably provided, or may be interchanged with other accessory holding devices.

In FIG. 1, the holding bars 400 may be provided at the underside of the base plate 100. As shown in FIG. 3, each of the holding bars 400 may be removably attached to the underside of the base plate by clamps 150, and ends 410 of the holding bars 400 may be free to rotate within the clamps 150. Here, each of the holding bars 400 may be spring biased to a corresponding one of the supporting portions 112*b* using a spring 420 to pivot around a pivot point below the base plate 100. Accordingly, in a rest position, the holding bars 400 are disposed at a position down below the supporting portions 112*b* due to the forces of the spring 420, as shown in FIG. 2. However, as shown in FIG. 1, the overall geometry and size of the holding bars 400 is such that when raised above the supporting portions 112*b* and the upper planar surface of the base plate 100 using the attachment strap 500, the holding bars 400 do not interfere or make contact with the supporting portions 112*b*. Here, the holding bars 400 are preferably configured to be substantially concentric with the supporting portions 112*b*.

The holding bars 400 may be formed of material(s) having substantially high mechanical strength, such as metal and composites. In addition, the holding bars 400 may be configured to freely move from the rest position to the raised position by manipulating the attachment strap 500. Here, in FIGS. 1 and 3, the attachment strap 500 is shown to include bar attachment members 510 and a central portion 520. The bar attachment members 510 are coupled to opposing portions of the holding bars 400, and the central portion 520 interconnects the bar attachment members 510. In addition, a pull handle 530 is provided at the central portion 520 to facilitate moving the holding bars 400 from their rest position to their raised position. As shown in FIG. 3, when the holding bars 400 are in their rest position, then attachment strap 500 is held in a slight tension mode such that there is no droop in the attachment strap 500. For example, the attachment strap 500 is preferably formed from elastic material(s) to allow for the holding bars 400 to be placed in their raised position will exhibiting substantial tension within the attachment strap 500, as will be described in detail below. In addition, it is preferable that the attachment strap 500 possesses heat resistance properties.

In FIGS. 1 and 3, although the attachment strap 500 is shown to be attached to the holding bars 400 at a location closer to the front portion 130, the attachment strap 500 may be positioned along opposing portions of the holding bars 400 anywhere between the front and rear portions 130 and 120. Moreover, the bar attachment members 510 may be formed of the same material(s) as the central portion 520, i.e., the attachment strap 500 is formed of one integral piece, or the bar attachment members 510 may be formed of different material(s) than those of the central portion. For example, the bar attachment members 510 may be formed of substantially plastic material(s) and then attached to opposing ends of the central portion 520. Then, the bar attachment members 510 may be simply clipped over the opposing portions of the holding bars 400.

In the event that the attachment strap 500 is formed of one integral piece, the bar attachment members 510 may be mounted onto the holding bars 400 by inserting the holding bars 400 through openings in the bar attachment member 510. Then, the bar attachment members 510 can be slid into place at desired locations on the opposing portions of the holding bars 400, and the ends 410 of the holding bars 400 may be positioned onto the underside of the base plate 100 using the clamps 150.

An exemplary method for using the iron holder 10 (in FIGS. 1-3) will now be explained with reference to FIGS. 4 and 5.

Figure 4:
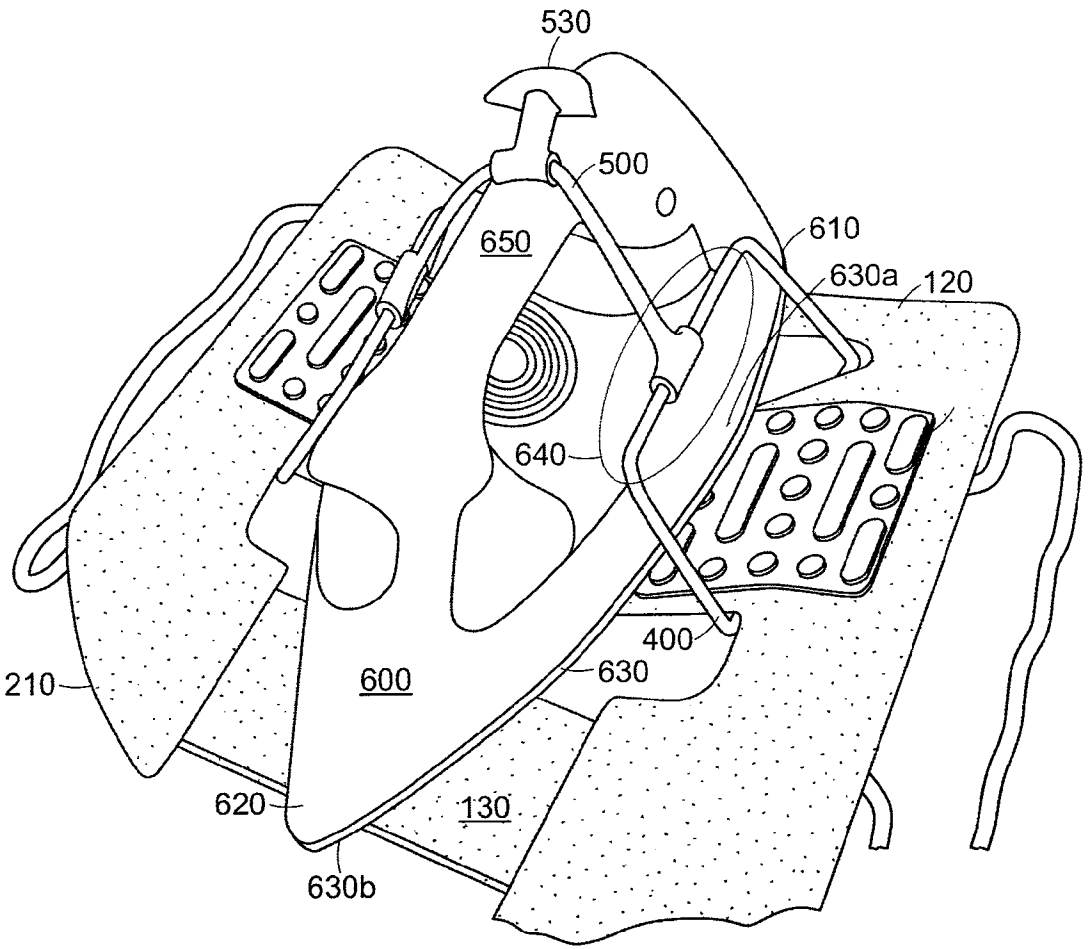
FIG. 4 is perspective view of using the exemplary system of FIG. 1 according to one embodiment.

As shown in FIG. 4, a clothes iron 600 may be positioned and retained on the iron holder system 10 using the attachment strap 500 and the base plate 100. First, without the clothes iron 600 positioned on the base plate 100, a user will first pull the attachment strap 500 using the pull handle 530 to move the holding bars 400 from a rest position below the base plate 100 to a raised position above the base plate 100. Then, the clothes iron 600 may be slid between the holding bars 400 and between the raised attachment strap 500 and the base plate 100 along a direction (in FIG. 1). Once the heal 610 and the nose 620 of the clothes iron 600 are positioned above the rear and front portions 120 and 130, respectively, the clothes iron 600 may be lowered onto the base plate 100 where side regions 630*a* of the iron shoe plate 630 may contact the inserts 114 disposed on the support portions 112*b*. In addition, and almost simultaneously, the heal 610 of the clothes iron 600 and the front portion 630*b* of the iron shoe plate 630 may come to rest onto the rear and front portions 120 and 130, respectively.

Next, due to the spring bias of the holding arms 400, the holding arms 400 are pressed against side regions 640 of the clothes iron 600. Here, the holding arms 400 are laterally spaced apart from the iron shoe plate 630. In addition, the tension within the attachment strap 500 maintains a downward force upon a handle portion 640 of the clothes iron 600. Moreover, the pull handle 530 can include can include a recess on an underside of the pull handle 530 that will trap the attachment strap 500 and lead the attachment strap 500 onto the handle portion 650 of the clothes iron 600, thereby keeping the attachment strap 500 away from the iron shoe plate 630. Accordingly, the clothes iron 600 is positively retained onto the iron holder 10 due to the spring bias of the holding arms 400, as well as the tension within the attachment strap 500 as it crosses over the handle portion 650.

As detailed above, since the rear portion 120 is disposed above the front portion 130 of the base plate 100 by the distance 'x' (in FIG. 2), which substantially corresponds to the spacing distance between the front portion 630*b* of the iron shoe plate 630 and the heal 610, the clothes iron 600 may be fully supported at the heal and nose 610 and 620 by the iron holder 10. Moreover, the support portions 112*b* provide complete laterally support to the side regions 630*a* of the iron show plate 630. Accordingly, the clothes iron 600 may be completely and fully retained by the iron holder 10 at both heal and nose 610 and 620, as well as lateral side regions 630*a*.

As detailed above, placement of the clothes iron 600 onto the iron holder 10 may be performed immediately after the ironing of clothes. Here, since the base plate 100 is formed of heat conductive material(s), and the front portion 130 of the base plate 100 makes direct contact with the front portion 630*b* of the iron shoe plate 630, residual heat from the just-used clothes iron 600 will be quickly and safely dissipated via conduction by the base plate 100. Moreover, the open region 140 (in FIG. 1) provides for convective dissipation of the residual heat.

Accordingly, by placement of the clothes iron 600 onto the iron holder 10, a cool-down period with the clothes iron 600 sitting on the heal 610 on the ironing board is not necessary, thereby reducing the possibility of damaging the clothes iron 600, the ironing board, and the floor by simply resting the clothes iron 600 on its heal 610 on the ironing board. In addition, when a user has completed ironing of the clothes and positioned the clothes iron 600 into the iron holder 10, the ironing board along with the iron holder 10 can be immediately closed, moved, and placed upright into storage without having to wait for completion of a cool-down period. In most instances, the iron board is collapsed and either hung on a wall or rested on its end region on the floor. Here, the iron holder 10 is positioned at the end region of the ironing board.

Then, when a user needs to iron clothes, the ironing board and attached iron holder 10 can be simultaneously removed from storage and set-up. Next, the user may pull upward on the pull handle 530 to partially remove the clamping forces of the holding arms 400 on the side regions 640 of the clothes iron 600, and slide-out the clothes iron 600 from the iron holder 10. As a result, the holding arms 400 will be placed into their rest position, as shown in FIG. 2, below the base plate 100.

When the user has again completed the task of ironing clothes, a simple pull upward on the pull handle 530 will place the holding arms 400 in the raised position and the clothes iron 600 may be slide into place onto the iron holder 10. Here, the user may use only one hand to raise the holding arms 400, and at the same time use the other hand to slide the clothes iron 600 into place onto the iron holder 10 to store the clothes iron 600. Similarly, removal of the clothes iron 600 from the iron holder 10 only requires the user's two hands in a relatively quick and efficient maneuver.

As will be understood by one skilled in the art, the present application is not limited to the precise exemplary embodiments described herein and various changes and modifications may be effected without departing from the spirit or scope of the application. For example, elements and/or features of different illustrative embodiments may be combined with each other, substituted for each other, and/or expanded upon within the scope of the present disclosure and the appended claims. In addition, improvements and modifications which become apparent to persons of ordinary skill in the art after reading the present disclosure and appended drawings are deemed within the spirit and scope of the present application.

What is claimed is:

1. A system for retaining a clothes iron, comprising:

a base plate having vertically offset front and rear portions configured to support a nose sole plate portion and a heal portion of the clothes iron, respectively, and lateral side portions configured to support opposing lateral side sole plate portions of the clothes iron;

a pair of holding arms configured to move from a first position below the base plate to a second position above the base plate and to contact side body portions of the clothes iron; and an attachment strap connected between the pair of holding arms.

2. The system according to claim 1, wherein the pair of holding arms are spring biased against the side body portions of the clothes iron.

3. The system according to claim 1, wherein the attachment strap include elastic material.

4. The system according to claim 1, wherein the pair of holding arms are configured to move from the first position to the second position by the attachment strap.

5. The system according to claim 4, wherein the attachment strap is configured to be positioned along a handle portion of the clothes iron when the pair of holding arms are at the second position.

6. The system according to claim 1, wherein each of the lateral side portions of the base plate include a removable insert formed of heat resistant material.

7. The system according to claim 6, wherein each of the opposing lateral side sole plate portions of the clothes iron contact the removable insert.

8. The system according to claim 1, further comprising a pair of accessory bars, each positioned along out edge portions of the base plate.

9. The system according to claim 8, wherein each of the accessory bars extend along a direction from the rear portion to the front portion of the base plate.

10. The system according to claim 8, wherein each of the accessory bars include rounded ends.

11. A system for retaining a clothes iron, comprising:

a base plate having vertically offset front and rear portions configured to support a nose sole plate portion and a heal portion of the clothes iron, respectively, and lateral side portions configured to support opposing lateral side sole plate portions of the clothes iron;

a pair of holding arms configured to move from a first position below the base plate to a second position above the base plate and to contact side body portions of the clothes iron; and a pair of accessory bars, each positioned along out edge portions of the base plate, wherein each of the accessory bars include a plurality of alternating curved portions.

12. The system according to claim 11, wherein the pair of holding arms are spring biased against the side body portions of the clothes iron.

13. The system according to claim 11, further comprising an attachment strap connected between the pair of holding arms.

14. The system according to claim 11, further comprising a pair of attachment arms configured to extend from one of the rear portion and the front portion of the base plate for attaching the system to an ironing board.

15. The system according to claim 11, wherein each of the holding arms are configured to be substantially concentric with the lateral side portions, wherein each of the holding arms pivot about a pivot point positioned below the lateral side portions, and wherein each of the holding arms are spring biased at the pivot point.

16. The system according to claim 1, further comprising a pair of attachment arms configured to extend from one of the rear portion and the front portion of the base plate for attaching the system to an ironing board.

17. The system according to claim 1, wherein each of the holding arms are configured to be substantially concentric with the lateral side portions.

18. The system according to claim 17, wherein each of the holding arms pivot about a pivot point positioned below the lateral side portions.

19. The system according to claim 18, wherein each of the holding arms are spring biased at the pivot point.

20. A support device for a clothes iron retaining system, comprising:

a base plate having a rear support portion configured to support a heal portion of the clothes iron, a front support portion configured to support a front shoe plate portion of the clothes iron, and opposing lateral side portions, each including a supporting portion configured to support opposing lateral shoe plate portions of the clothes iron, wherein the rear support portion and the front support portion are offset along a vertical direction corresponding to a height difference between the heal and front shoe plate portions of the clothes iron, and wherein the base plate includes a generally I-shaped opening between the rear and front support portions and the opposing lateral side portions.

21. The device according to claim 20, wherein the base plate includes a spacing between the opposing lateral side portions at a position corresponding to the front support portion.

22. The device according to claim 20, wherein the supporting portion extends inwardly to a position below the front support portion along the vertical direction.

23. The device according to claim 22, wherein the supporting portion includes a heat resistant insert.

24. The device according to claim 23, wherein the heat resistant insert includes a plurality of raised members.

25. A system for retaining a clothes iron, comprising:

a base plate having vertically offset front and rear portions configured to support a nose sole plate portion and a heal portion of the clothes iron, respectively, and lateral side portions configured to support opposing lateral side sole plate portions of the clothes iron;

a pair of holding arms configured to move from a first position below the base plate to a second position above the base plate and to contact side body portions of the clothes iron; and a pair of accessory bars, each positioned along out edge portions of the base plate, wherein each of the accessory bars are attached to an underside of the base plate.

26. The system according to claim 25, wherein the pair of holding arms are spring biased against the side body portions of the clothes iron.

27. The system according to claim 25, further comprising an attachment strap connected between the pair of holding arms.

28. The system according to claim 25, further comprising a pair of attachment arms configured to extend from one of the rear portion and the front portion of the base plate for attaching the system to an ironing board.

29. The system according to claim 25, wherein each of the holding arms are configured to be substantially concentric with the lateral side portions, wherein each of the holding arms pivot about a pivot point positioned below the lateral side portions, and wherein each of the holding arms are spring biased at the pivot point.

30. A support device for a clothes iron retaining system, comprising:

a base plate having a rear support portion configured to support a heal portion of the clothes iron, a front support portion configured to support a front shoe plate portion of the clothes iron, and opposing lateral side portions, each including a supporting portion configured to support opposing lateral shoe plate portions of the clothes iron, wherein the rear support portion and the front support portion are offset along a vertical direction corresponding to a height difference between the heal and front shoe plate portions of the clothes iron, and wherein the rear support portion includes a curved surface.

* * * * *